US008296890B2

(12) United States Patent
Issler et al.

(10) Patent No.: US 8,296,890 B2
(45) Date of Patent: Oct. 30, 2012

(54) METHOD FOR PROVIDING A WEATHERED SHOE AND THE WEATHERED SHOE

(75) Inventors: James E. Issler, Greenwich, CT (US); Jonathan K. Lebo, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 516 days.

(21) Appl. No.: 12/582,800

(22) Filed: Oct. 21, 2009

(65) Prior Publication Data

US 2011/0088286 A1 Apr. 21, 2011

(51) Int. Cl.
*A43D 11/00* (2006.01)
*A43B 23/16* (2006.01)

(52) U.S. Cl. ..... 12/142 C; 12/142 T; 36/45; 36/98

(58) Field of Classification Search ..... 12/142 C, 12/142 R, 142 RS, 142 T, 146 B, 146 C
See application file for complete search history.

(56) References Cited

U.S. PATENT DOCUMENTS

| | | | | |
|---|---|---|---|---|
| 4,845,790 | A * | 7/1989 | Brasington | 8/150 |
| 5,298,316 | A * | 3/1994 | Coughlin | 442/148 |
| 5,558,676 | A * | 9/1996 | Gray et al. | 8/107 |
| 5,653,770 | A * | 8/1997 | Goldstein et al. | 8/114 |
| 6,702,861 | B2 * | 3/2004 | Trask et al. | 8/114 |
| 7,140,313 | B2 * | 11/2006 | Neustat | 112/475.08 |
| 7,891,035 | B2 * | 2/2011 | Howley et al. | 12/142 R |
| 2005/0065059 | A1 * | 3/2005 | Roselle et al. | 510/475 |

OTHER PUBLICATIONS

Halbert, Lucas; Rubenstein, Ben, et al.; www.wikihow.com; "How to Make Dirty Denim Distressed Cut Off Shorts"; Dec. 10, 2009.
Spies; Kelly; www.associatedcontent.com; "How to Make Destroyed and Distressed Jeans"; Oct. 16, 2007.
Gramicci; www.sonomaoutfitters.com, Jan. 12, 2010.
www.shoesfourless.com, Patagonia Pita & Hummus—Stonewash Suede, May 26, 2009.
www.footwearetc.com, Authentic UGG Australia Women's Classic Cardy #5819—Stonewash Blue,
www.shoes.com, Rocket Dog Women's Memories, Gold Stonewash Metal, May 26, 2009.
Raven, Robin; www.ehow.com; "How to Acid Wash Clothes"; May 26, 2009.
Brister, Jennifer; www.ehow.com; "How to Stonewash Jeans"; May 26, 2009.
Doshi, Gaurav; www.ezinearticles.com; "Stonewash Finish for Denim"; May 26, 2009.
www.blurtit.com; "How Do I Acid Wash Jeans At Home?"; May 26, 2009.

* cited by examiner

*Primary Examiner* — Ted Kavanaugh
(74) *Attorney, Agent, or Firm* — IP Attorneys Group, LLC

(57) ABSTRACT

The invention relates to a method for providing a shoe having the steps of providing an upper, a sole, and a stitching; washing the upper for achieving a weathered appearance of the upper without subjecting the stitching and sole to the washing; and softening the sole. The method also comprises stitching the sole and the upper together with the stitching; working the sole to weather an appearance of the sole; drying the upper and sole together for disfiguring the upper and sole and for achieving a generally uniform weathered appearance; cyclically working the sole to match the appearance of the upper; and cyclically working the upper to match the appearance of the sole. The invention also includes the shoe.

17 Claims, 4 Drawing Sheets

METHOD FOR PROVIDING A WEATHERED SHOE AND THE WEATHERED SHOE

FIELD OF THE INVENTION

Figure 1:
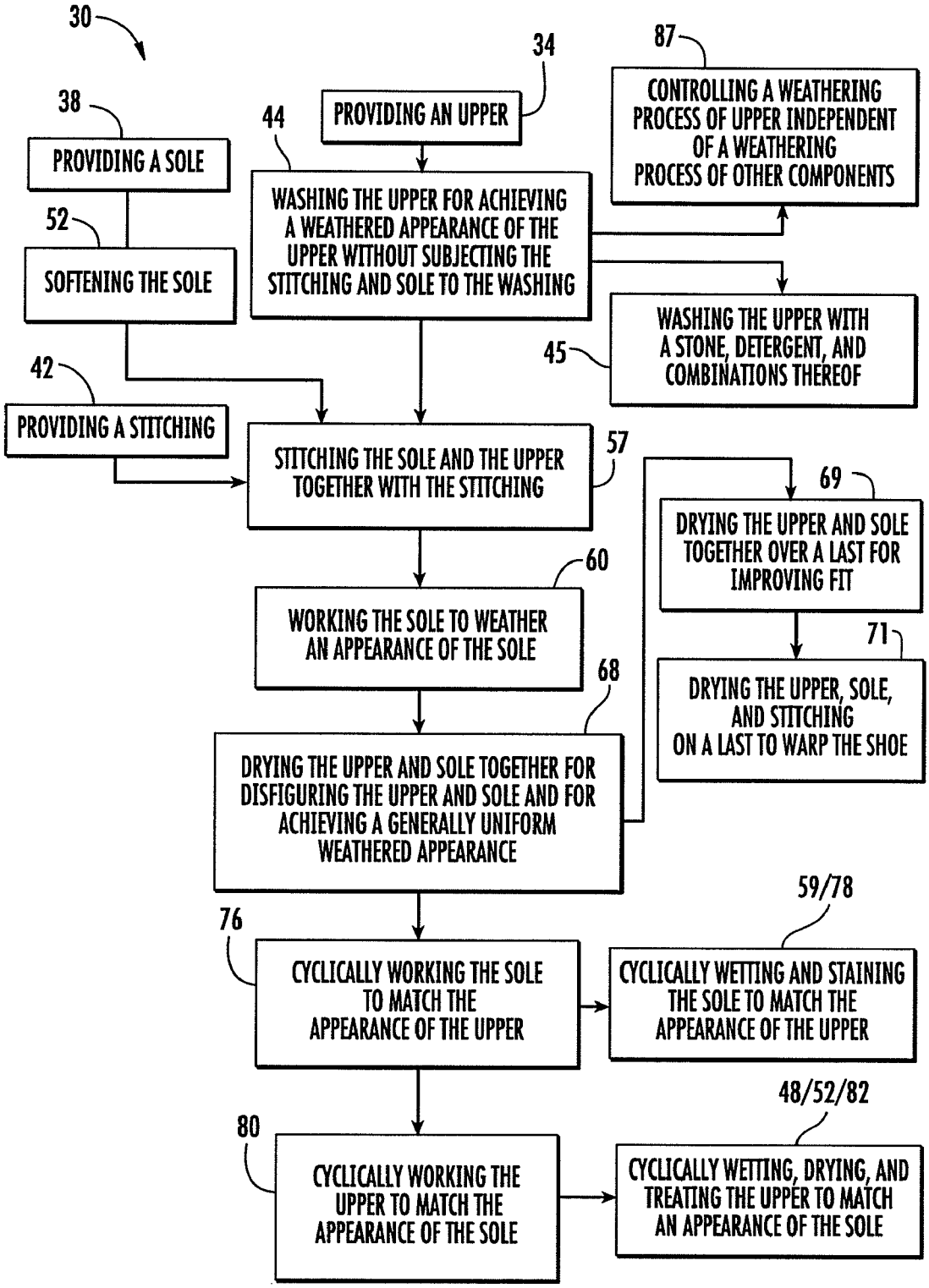

The invention relates to a method for providing a weathered shoe and the weathered shoe.

1. BACKGROUND OF THE INVENTION

Weathered clothing and a process for producing weathered clothing are known. One process for giving a newly manufactured cloth garment a worn-out, or weathered, appearance is referred to as stone washing and the process may also help increase the material's softness and flexibility, which may be desirable in the case of stiff and rigid fabrics such as canvas or denim.

The process typically involves placing finished garments and stones, such as pumice stones, together in a clothes washer where the stones would roughen up the fabric. Prior to being placed in the washer, the garments are finished in accordance with processes known in the trade and are in otherwise new condition.

In another process, new or finished garments are treated with a chemical, such as bleach or other detergent, to produce a faded, worn appearance. This may involve simply placing the chemicals directly on the finished or new garments. In other instances, this may entail washing finished or new garments with chemicals in a washing machine. These prior art processes for providing weathered or worn garments were often called stone washing or acid washing.

A disadvantage of all of the above prior art processes is that the strength of the materials were weakened and subject to tearing more than non-weathered garments. In some cases, holes were formed or the garments were more easily susceptible to holes than non-weathered garments. In addition, because the garments are finished or completed prior to being treated with chemicals or washing, the stitchings used to sew the garments together are weathered along with the fabric and, as a result, the stitchings are weakened and this is particularly problematic since the stitchings are easily torn or broken even in new condition, never mind a worn condition. In addition to the stitchings, the linings for pant pockets or jackets are typically weaker and less durable than other materials of the garments and may tear more easily.

What is desired, therefore, is a method for providing a weathered garment that overcomes the disadvantages of the prior art. A further desire is a method for providing a garment with a weathered or worn appearance that does not weaken or wear upon the stitches or other materials. Another desire is a way to control the weathering process for providing a garment with a weathered or worn appearance without sacrificing material strength.

2. SUMMARY

Bearing in mind the problems and deficiencies of the prior art, it is therefore an object of the present invention to provide a method of providing a shoe with a weathered appearance that does not involve weathering the stitches or other delicate components.

It is another object of the present invention to provide a method of controlling a weathering process of components independent from each other.

Still other objects and advantages of the invention will in part be obvious and will in part be apparent from the specification.

These and others objects are achieved by a method for providing a shoe, comprising the steps of providing an upper, a sole, and a stitching; washing the upper for achieving a weathered appearance of the upper without subjecting the stitching and sole to the washing; and softening the sole. The method also comprises stitching the sole and the upper together with the stitching; working the sole to weather an appearance of the sole; drying the upper and sole together for disfiguring the upper and sole and for achieving a generally uniform weathered appearance; cyclically working the sole to match the appearance of the upper; and cyclically working the upper to match the appearance of the sole.

In some embodiments, the method treats the upper with a fatiguing agent without subjecting the stitching and sole to the fatiguing agent. In variations of these embodiments, the method washes the upper with a stone, detergent, and combinations thereof. In an optional embodiment, the method cyclically washing the upper to enhance the weathered appearance.

In other embodiments, the method includes the step of cyclically wetting, drying, and treating the upper to match an appearance of the sole.

In further embodiments, the method cyclically wets and stains the sole to match the appearance of the upper.

In another embodiment, the method dries the upper and sole together over a last for improving fit.

In another aspect of the invention, a method for providing a shoe includes partially drying the upper for disfiguring the upper and for enhancing the weathered appearance of the upper; partially stitching the sole and the upper together; staining the sole; continue drying the upper and sole together to achieve a generally uniform weathered appearance; continue stitching a remainder of the weathered upper to the weathered sole with the stitching; cyclically working and staining the sole to match the appearance of the upper; and cyclically working and treating the upper to match the appearance of the sole.

In some embodiments, the method also includes controlling a drying process of the upper to coincide with a drying process of the sole for achieving a similar weathered appearance for both the upper and sole.

In other embodiments, the method has the step of cyclically wetting and drying the sole and upper for disfiguring the sole and upper and for achieving a similar weathered appearance for both the upper and sole.

In further embodiments, the method further comprises the step of treating the upper contemporaneously with drying the upper for enhancing the weathered appearance of the upper. In a variation of these embodiments, the method treats the upper with a fatiguing agent without subjecting the stitching and sole to the fatiguing agent.

In another embodiment, the method dries the upper, sole, and stitching on a last to warp the shoe.

In other embodiments, the method has the step of controlling a treating process of the upper for matching a weathered appearance of the sole.

In further embodiments, the method controls a working process of the sole for matching a weathered appearance of the upper.

In an optional embodiment, the method includes the step of controlling a washing process of the upper for matching a weathered appearance of the sole.

In yet another embodiment, the method has the step of controlling a weathering process of upper independent of a weathering process of other components.

In another aspect of the invention, a shoe comprises an upper and a sole, where the upper having a disfigurement and a washed appearance for enhancing a weathered appearance of the upper and where the sole and the stitch are without the washed appearance. The shoe also includes a stitching for connecting the sole and the upper together. The sole has a cold worked blemish and a stain for enhancing a weathered appearance of the sole, and the upper and the sole have a generally uniform weathered appearance.

In some embodiments, the also includes a fatiguing agent applied to the upper without being applied to the sole or the stitching.

3. BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 depicts the method for providing a shoe in accordance with the invention.

Figure 2:
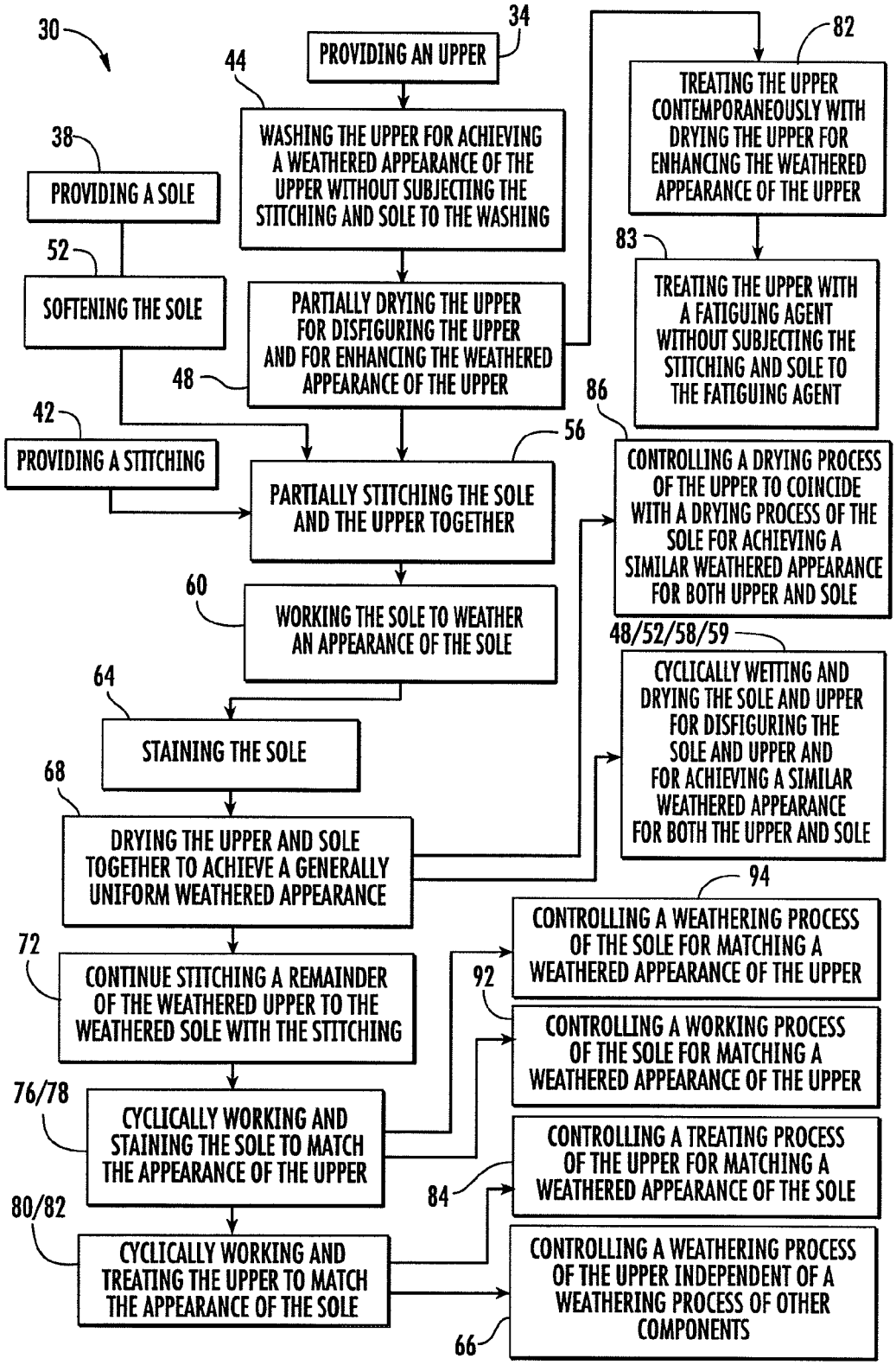

FIG. 2 more particularly depicts the method shown in FIG. 1.

Figure 3:
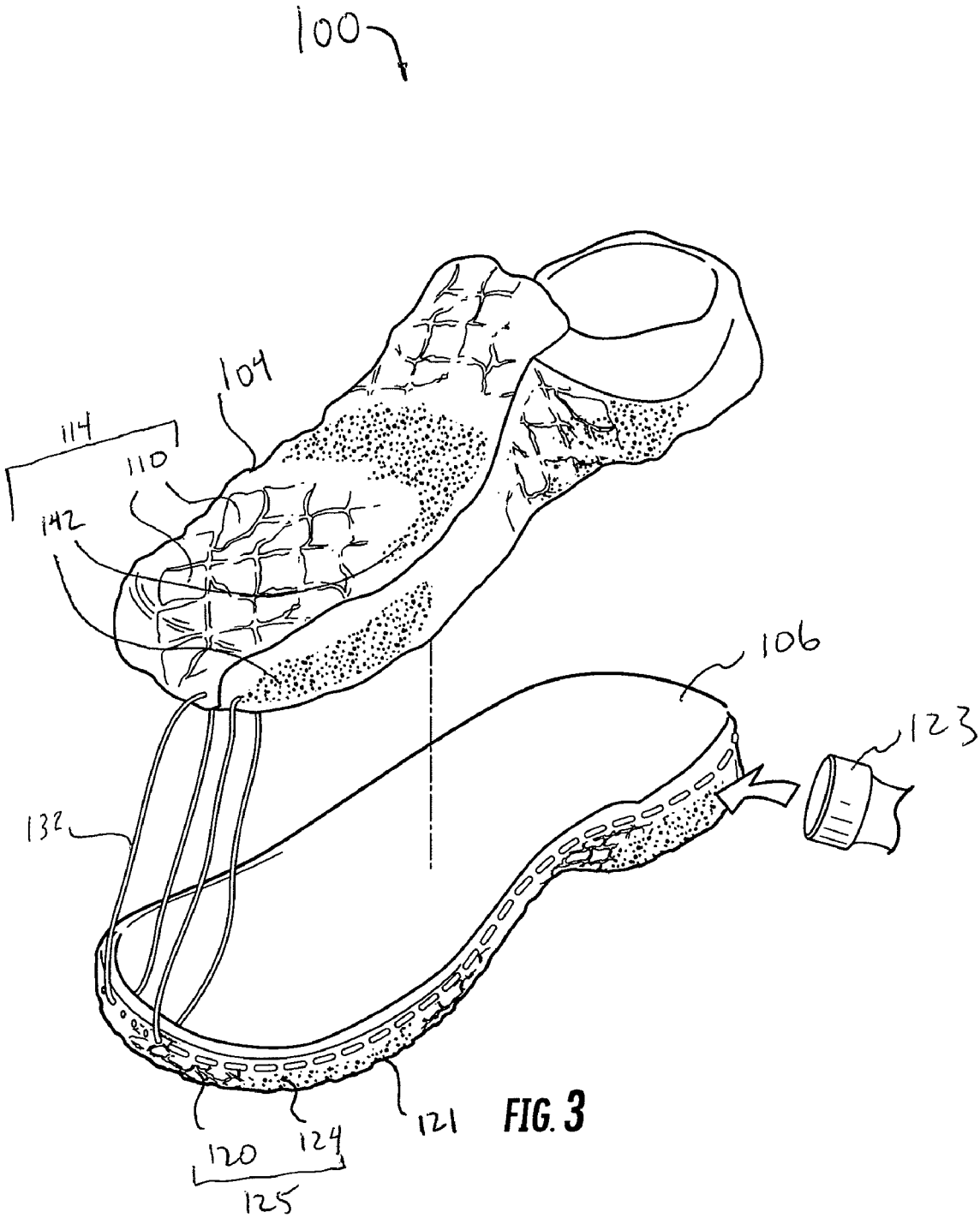

FIG. 3 depicts the shoe made in accordance with the method of FIG. 1.

Figure 4:
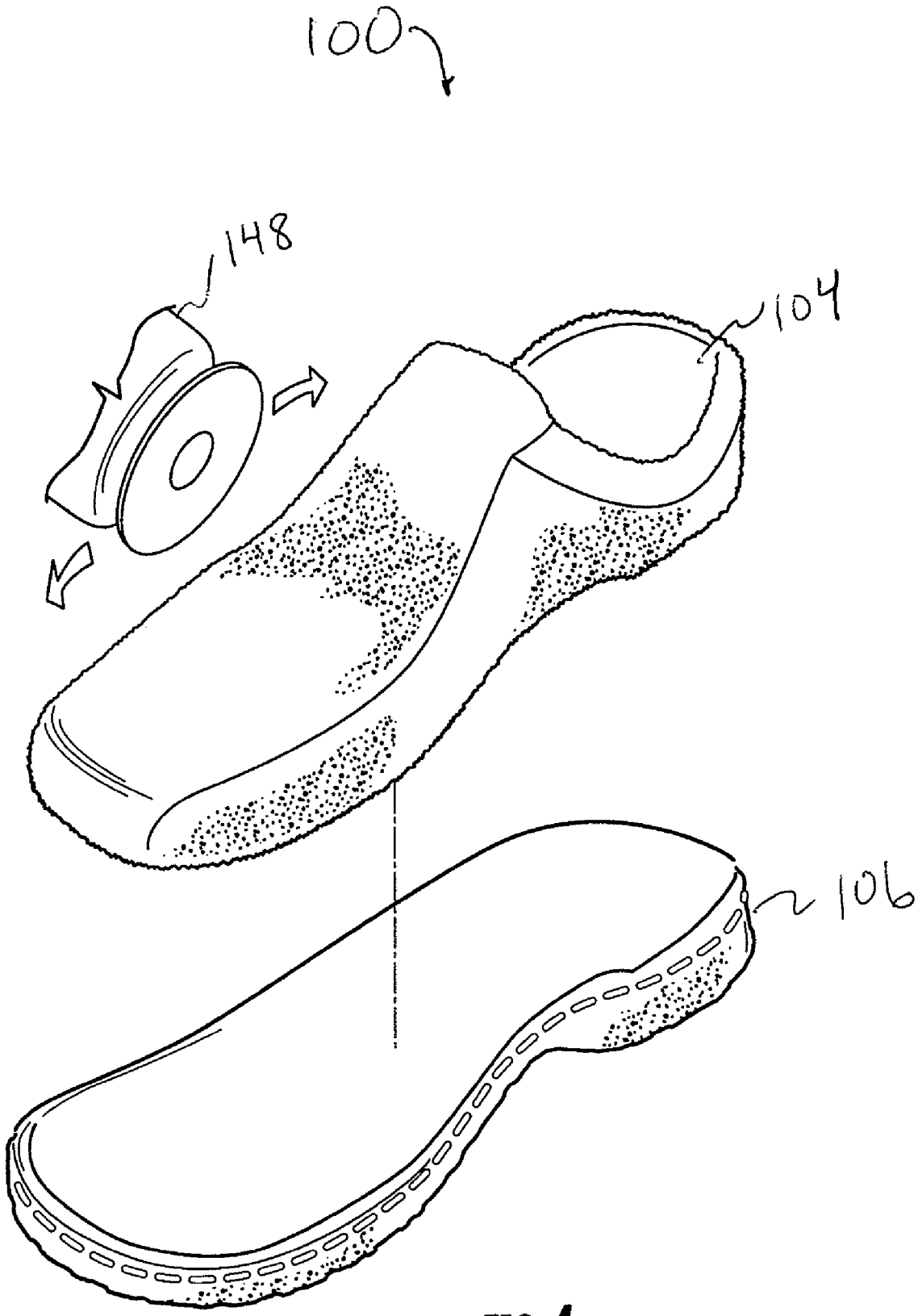

FIG. 4 more particularly depicts the shoe made in accordance with the method of FIG. 1.

4. DETAILED DESCRIPTION

In describing the preferred embodiment of the present invention, reference will be made herein to FIGS. 1-4 of the drawings in which like numerals refer to like features of the invention.

The invention includes method 30 for providing a shoe, comprising the steps of providing 34 an upper, providing 38 a sole, and providing 42 a stitching. Method 30 also includes washing 44 the upper for achieving a weathered appearance of the upper without subjecting the stitching and sole to the washing, partially drying 48 the upper for disfiguring the upper and for enhancing the weathered appearance of the upper, and softening 52 the sole. Method 30 further includes partially stitching 56 the sole and the upper together, working 76 the sole to weather an appearance of the sole, staining 64 the sole; drying 68 the upper and sole together to achieve a generally uniform weathered appearance; continue stitching 72 a remainder of the weathered upper to the weathered sole with the stitching; cyclically working 76 and staining 78 the sole to match the appearance of the upper; and cyclically working 80 and treating 82 the upper to match the appearance of the sole.

Method 30 integrates the steps for washing the upper, drying the upper and/or sole, working the upper and/or sole, and staining the sole with the construction of the shoe in order to control the weathering of the shoe more advantageously than the prior art, which typically relates to placing a new shoe, or shoe finished in a traditional manner, into a washing machine. A shoe made in accordance with the prior art is inferior because the entire shoe is subject to the washing process and this may lead to premature failure of the stitching and/or sole.

When washing 44 the upper, method 30 typically uses a standard wash cycle through an industrial washing machine. In some embodiments, the upper is washed 45 with a fatiguing agent. In some of these embodiments, the fatiguing agent is a bleach, soap, or other detergent. In a further embodiment, the fatiguing agent is a pumice stone or other abrasive. In another embodiment, multiple fatiguing agents are washed with the upper. The above variations and combinations thereof provide various weathered appearances of the upper, and all are contemplated in the step of washing 44 the upper. It should be noted that the step of washing 44 the upper does not include washing or weather the sole or stitching. In fact, the sole is weathered independently of the upper and the stitchings are not weathered.

After washing, method 30 includes the step of drying 48 the upper so that the upper material, typically leather or other organic material, wrinkles or disfigures naturally without human intervention. Such wrinkling or disfiguring enhances the weathered appearance. In some embodiments, such drying 48 is partial and the upper should be moist or somewhat wet to facilitate assembly with the sole. In other embodiments, the drying 48 step includes thoroughly drying the upper to maximize the amount of wrinkling or disfiguring. In further embodiments, the upper is dried and subsequently rewetted for assembly with the sole.

Method 30 also includes softening 52 the sole, which is achieved by wetting or dampening the sole with a softener or water. Softening 52 the sole facilitates attachment to the upper via stitching. In addition, once wet, which is typically how method 30 softens the sole, the sole is easier to weather or fatigue via cold working, or physically striking. Once softened, sole is stitched 56 to the upper and then worked 76. It should be noted that stitching 56 the sole to the upper is conducted around a part of the perimeter of the shoe. In other words, the upper and sole are partially stitched 56 together. In further embodiments, method completely stitches 57 the sole and upper together around the entire perimeter.

In some embodiments, the sole is stained 64 after the stitching 56/57 and working 76, where working 76 is any physical strike delivered to the sole, such as hammering, cobbling, tumbling, and the like. In some embodiments, the steps of staining 64, stitching 56/57, and working 76 are in any combination of sequences. In further embodiments, any one or more of these steps are repeated in order to achieve a particular weathered appearance. For example, sole may be worked 76 after softening and prior to being partially stitched 56/57 and then worked 76 again.

The reason for the partial stitching is so that a last (form or model of a foot) is placed within the shoe or between the partially stitched upper and sole, where the upper and sole are permitted to dry while the last is in the shoe. This permits the upper and sole to dry around and warp around the last, which improves the fit of the shoe and enhances comfort. Moreover, by drying 69 upper and sole over the last, both upper and sole will have a generally more uniform weathered appearance as opposed to being dried separately. Further, any disfigurements in the area of where upper and sole contact each other will be common to both upper and sole, which enhances the generally uniform weathered appearance since both have similar disfigurements. In some embodiments, the upper, sole, and stitching are dried 71 on the last.

In a further embodiment, method 30 further comprises the step of cyclically drying and wetting both the upper and sole on the last to warp the shoe. In some of these embodiments, drying 48 and wetting 52 of the upper is conducted independently and separately with the drying 58 and wetting 59 of the sole. In other embodiments, drying 48 and wetting 52 of the upper is conducted contemporaneously with the drying 58 and wetting 59 of the sole.

In another embodiment, the upper and sole are partially dried over the last while some embodiments dry the upper and sole completely. These embodiments of the invention are part of the step of controlling 86 a drying process of the upper to coincide with a drying process of the sole for achieving a similar weathered appearance for both the upper and sole.

In a further embodiment, method 30 includes controlling 87 a weathering process of the upper by weathering the upper separately or contemporaneously with the sole using any one or combination of the manners described herein for achieving particular disfigurements and weathered appearances for both the upper and sole, including cyclically working 76, washing 44, drying 48, and/or treating 82 the upper for matching a weathered appearance of the sole Method 30 further includes continually stitching 72 the rest of the upper and sole together with the stitching. In some embodiments, method 30 cyclically works 76 the sole to enhance the weathered appearance and to match the appearance of the upper. In other embodiments, method 30 cyclically stains 78 the sole instead of or in addition to the working 76 step to further enhance the weathered appearance and to match the appearance of the upper. In yet another embodiment, the sole is subjected to any combination of drying 58, wetting 59, and staining 78.

In another embodiment, method 30 cyclically works 80 the upper by physically hammering or striking the upper to enhance the weathered appearance and to match the appearance of the sole. In other embodiments, method 30 cyclically treats 82 the upper with a fatiguing agent instead of or in addition to the working 80 step to further enhance the weathered appearance and to match the appearance of the sole.

In some embodiments, a fatiguing agent is a soap or detergent, such as bleach. In another embodiment, the fatiguing agent is a pumice stone or other abrasive. In a further embodiment, the fatiguing agent is a burnishing material, such as a wire or abrasive material, for polishing the upper. In an optional embodiment, the fatiguing agent is a stain. In another embodiment, fatiguing agent 142 is a rock, detergent, chemical, and the like.

In addition to the foregoing, some embodiments include the step of treating 82 the upper contemporaneously with drying 48 the upper for enhancing the weathered appearance of the upper.

In other embodiments, method 30 treats 83 the upper with a fatiguing agent without subjecting the stitching and sole to the fatiguing agent. This enables the upper to be weathered without weathering the other components of the shoe, which may lead to premature failure of the shoe.

In an optional embodiment, method 30 also comprises the step of controlling 84 a treating process of the upper for matching a weathered appearance of the sole, where controlling includes any one or combination of treating 82 manners described above. By controlling the treating, washing, drying, burnishing, and cold working processes of the upper, method 30 is controlling 66 a weathering process of the upper.

In fact, method 30 controls a weathering process of each component of the shoe, such as the stitching, sole, and any other component because method 30 weathers the upper without subjecting the stitching or sole to the weathering process.

Method 30 also includes the step of controlling 92 a working process of the sole for matching a weathered appearance of the upper. In a further embodiment, method 30 includes controlling 94 a weathering process of the sole by weathering the sole separately or contemporaneously with the upper using any one or combination of the manners described herein for achieving particular disfigurements and weathered appearances for both the upper and sole, including cyclically working, drying, and/or staining the sole for matching a weathered appearance of the upper. By controlling the working, staining, drying, and softening processes of the sole, method 30 is controlling 94 a weathering process of the sole. Moreover, method 30 permits controlling 66 a weathering process of upper independent of a weathering process of other components.

In another aspect of the invention shown in FIGS. 3-4, shoe 100 is provided, where shoe 100 has upper 104 and sole 106, where upper 104 has disfigurement 110 and washed appearance 114 for enhancing a weathered appearance of the upper. Sole 106 has cold worked blemish 120 and stain 124 for enhancing weathered appearance 125 of sole 106. Stain 124 is applied by any known or novel manner, such as via stain applicator 123. It is understood that cold worked blemish 120 includes dent 121 or deformation in sole 106.

It should be noted both sole 106 and stitch 132 are without the washed appearance, where stitch 132 is for connecting sole 106 and upper 104 together. Because sole 106 has at least one cold worked blemish 120 and upper 104 has washed appearance 114, both sole 106 and upper 104 have a generally uniform weathered appearance.

In some embodiments, fatiguing agent 142 is applied to upper 104 without being applied to sole 106 or stitch 132. Fatiguing agent 142 includes the same limitations as described above.

In another embodiment shown in FIG. 4, burnishing wheel 148 is used to burnish upper 104. In some of these embodiments, oil, dye, shoe polish, and combinations thereof are used with burnishing wheel 148 to treat upper 104.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

EXAMPLE

Upper Procedure

1. Dip assembled upper in Slocum M-102 Leather Softener 5 seconds.
2. Twist upper to squeeze out excess solution.
3. Rinse assembled upper in washing machine thru rinse cycle only 24 minutes.
4. While upper is still wet put in tower dryer at 110 degrees for 20 minutes or until upper is 50% dry.
5. Stain leather outsole brand sole before cementing.

Lasting Procedure

6. Pull from tower dryer and toe last while still wet.
7. Side last and heel seat wet uppers, soak soles in water for 20 min. before sole lay.

Making Procedure

8. Approximately 2-3 hours from upper dipped, goodyear stitch soles while soles are wet.
9. Hand roll sole bottom with roller to bury stitches/shape sole.
10. Process of assembled upper to here approximately 5 hours.

Finishing Procedure for Sole and Heel

11. Edge trim sole with round cutter.
12. Stain sole edge and bottom.
13. Hand cobble sole edge to upper for worn appearance.
14. Let footwear dry on last overnight; approximately 6 to 7 hours since to this point form the initial upper being dipped.
15. Pull lasts and attach heel to sole bottom. Heel shave/rough scour heel.

16. Stain heel to match sole bottom and edge, soak heel and hand cobble to match sole.

17. Put footwear on drying rack for 30 minutes to ensure proper drying inside.

Bottom Finishing Procedure

18. Burnish outsole edge, bottom, and heel using Prime Leather burnishing wax with a horse hair brush.

Upper Finishing Procedure

19. Clean upper and burnish as needed on #3 brush with /54-0056 Natural Super bar from Prime.

20. Spray on 43-0340. Prime leather finish, hand polish to shine.

21. Burnish on #3 brush with Prime 54-8546 wax.

22. Brush polish on soft yarn wheel with Prime 43-0254 polish to final luster.

The invention claimed is:

1. A method for providing a shoe, comprising the steps of:
providing an upper, a sole, and a stitching;
washing the upper for achieving a weathered appearance of the upper without subjecting the stitching and sole to the washing;
softening the sole;
stitching the sole and the upper together with the stitching;
working the sole to weather an appearance of the sole;
drying the upper and sole together for disfiguring the upper and sole and for achieving a generally uniform weathered appearance;
cyclically working the sole to match the appearance of the upper; and
cyclically working the upper to match the appearance of the sole.

2. The method according to claim 1, further comprising the step of treating the upper with a fatiguing agent without subjecting the stitching and sole to the fatiguing agent.

3. The method according to claim 2, further comprising the step of cyclically wetting, drying, and treating the upper to match an appearance of the sole.

4. The method according to claim 1, further comprising the step of cyclically wetting and staining the sole to match the appearance of the upper.

5. The method according to claim 1, further comprising the step of drying the upper and sole together over a last for improving fit.

6. The method according to claim 1, further comprising the step of washing the upper with a stone, detergent, and combinations thereof.

7. The method according to claim 1, further comprising the step of controlling a weathering process of upper independent of a weathering process of other components.

8. A method for providing a shoe, comprising the steps of:
providing an upper, a sole, and a stitching;
washing the upper for achieving a weathered appearance of the upper without subjecting the stitching and sole to the washing;
partially drying the upper for disfiguring the upper and for enhancing the weathered appearance of the upper;
softening the sole;
partially stitching the sole and the upper together;
working the sole to weather an appearance of the sole;
staining the sole;
continue drying the upper and sole together to achieve a generally uniform weathered appearance;
continue stitching a remainder of the weathered upper to the weathered sole with the stitching;
cyclically working and staining the sole to match the appearance of the upper; and
cyclically working and treating the upper to match the appearance of the sole.

9. The method according to claim 8, further comprising the step of controlling a drying process of the upper to coincide with a drying process of the sole for achieving a similar weathered appearance for both the upper and sole.

10. The method according to claim 8, further comprising the step of cyclically wetting and drying the sole and upper for disfiguring the sole and upper and for achieving a similar weathered appearance for both the upper and sole.

11. The method according to claim 8, further comprising the step of treating the upper contemporaneously with drying the upper for enhancing the weathered appearance of the upper.

12. The method according to claim 11, further comprising the step of treating the upper with a fatiguing agent without subjecting the stitching and sole to the fatiguing agent.

13. The method according to claim 8, further comprising the step of drying the upper, sole, and stitching on a last to warp the shoe.

14. The method according to claim 8, further comprising the step of controlling a treating process of the upper for matching a weathered appearance of the sole.

15. The method according to claim 8, further comprising the step of controlling a working process of the sole for matching a weathered appearance of the upper.

16. The method according to claim 8, further comprising the step of controlling a weathering process of the sole for matching a weathered appearance of the upper.

17. The method according to claim 8, further comprising the step of controlling a weathering process of upper independent of a weathering process of other components.

* * * * *